US006662480B1

(12) United States Patent
Stevens

(10) Patent No.: US 6,662,480 B1
(45) Date of Patent: Dec. 16, 2003

(54) BUCKET LEVEL

(76) Inventor: Timothy J. Stevens, 145 8th St. SW., Buffalo, MN (US) 55313

( * ) Notice: Subject to any disclaimer, the term of this patent is extended or adjusted under 35 U.S.C. 154(b) by 0 days.

(21) Appl. No.: 10/230,013

(22) Filed: Aug. 28, 2002

(51) Int. Cl.[7] ..... E02F 3/40
(52) U.S. Cl. ..... 37/444; 172/817
(58) Field of Search ..... 172/810, 817, 172/811; 37/444, 445, 901

(56) References Cited

U.S. PATENT DOCUMENTS

| | | | | | |
|---|---|---|---|---|---|
| 656,987 | A | * | 8/1900 | Luther | 37/444 |
| 1,478,301 | A | * | 12/1923 | Shea | 37/444 |
| 1,493,698 | A | * | 5/1924 | Pearson | 37/444 |
| 1,550,938 | A | * | 8/1925 | Walsh | 414/725 |
| 1,704,425 | A | * | 3/1929 | Bruning | 414/725 |
| 2,433,019 | A | * | 12/1947 | Arps | 37/408 |
| 2,443,884 | A | * | 6/1948 | Arps | 37/408 |
| 2,556,592 | A | * | 6/1951 | Markkula | 414/704 |
| 3,319,367 | A | * | 5/1967 | Lewis | 37/444 |
| 3,424,251 | A | * | 1/1969 | Bouley | 172/810 |
| 4,081,919 | A | * | 4/1978 | Teach | 37/444 |
| 4,517,756 | A | * | 5/1985 | Olds et al. | 37/444 |
| 4,749,048 | A | | 6/1988 | Kelly | |
| 4,924,945 | A | | 5/1990 | Mork | |
| 4,939,855 | A | * | 7/1990 | McCreary, Jr. | 37/444 |
| 5,114,296 | A | * | 5/1992 | Badder | 414/607 |
| D335,131 | S | | 4/1993 | Devaney | |
| 5,211,247 | A | | 5/1993 | Johnsen | |
| 5,307,571 | A | * | 5/1994 | Behlendorf et al. | 37/396 |
| 5,353,531 | A | * | 10/1994 | Doucette | 37/444 |
| 5,367,796 | A | * | 11/1994 | Bowers et al. | 37/410 |
| D358,401 | S | | 5/1995 | Devaney | |
| 5,416,990 | A | * | 5/1995 | Otwell | 37/445 |
| 5,469,647 | A | * | 11/1995 | Profio | 37/398 |
| 5,526,591 | A | * | 6/1996 | Otwell | 37/444 |
| 5,839,212 | A | * | 11/1998 | Brinker | 37/416 |
| 6,035,562 | A | | 3/2000 | Virnig et al. | |
| 6,067,733 | A | * | 5/2000 | Gasper | 37/367 |
| 6,467,202 | B1 | * | 10/2002 | Brown, Jr. | 37/445 |

FOREIGN PATENT DOCUMENTS

| | | | | | |
|---|---|---|---|---|---|
| DE | 3207664 | A1 | * | 9/1983 | E02F/3/40 |
| GB | 2191464 | A | * | 12/1987 | E02F/3/81 |
| JP | 2002348904 | A | * | 12/2002 | E02F/3/40 |
| JP | 2003113618 | A | * | 4/2003 | E02F/3/40 |

* cited by examiner

*Primary Examiner*—Thomas B. Will
*Assistant Examiner*—Kristine Florio

(57) ABSTRACT

The present invention provides an apparatus and a method for landscaping or leveling a ground surface wherein the apparatus is selectively configurable to adopt a bucket or a leveling bar configuration. The apparatus is mountable to a motive power source such as a skid steer loader, tractor, or the like. The apparatus may have a frame substantially configured as a bucket with a floor having front, middle, and rear sections, with the front and rear sections being fixedly attached to the side walls and the middle section being movable relative to the side walls to raise it above the front and rear sections to form a leveling bar. The apparatus may also have a pivotable door or gate that opens when the middle floor section is raised to create a material flow-through during operation.

14 Claims, 4 Drawing Sheets

BUCKET LEVEL

The present invention relates generally to apparatus and method for landscaping preparations and particularly to an apparatus and method for preparing a site for landscaping by moving dirt and leveling the ground as desired.

BACKGROUND OF THE INVENTION

At times during the preparation of a site for final landscaping substantial reworking of the soil is necessary. This reworking of the soil can involve smoothing and/or leveling of the ground surface before the desired plantings and other landscaping features can be added. Where precision is not required, often a blade or bucket attached to and pushed by a skid-steer loader, tractor or other motive power source is used to move the dirt around as desired. Subsequently, it is typically necessary to change attachments and mount a leveling bar to the motive power source to level the ground to the preferred specifications. Landscapers are therefore typically required to purchase two separate attachments and devote precious time and labor to changing attachments from bucket or blade to leveling bar and back, resulting in lost time, increased labor costs, and, perhaps most importantly, additional obstacles to a rapid completion of a landscaping task.

It would be desirable to have an apparatus both for the selective removal of dirt and foliage to a desired depth and for the subsequent leveling of the terrain.

BRIEF DESCRIPTION OF THE INVENTION

It is an object of the present invention to provide new and useful apparatus that is not subject to the previously mentioned disadvantages.

It is another object of the present invention to provide a landscaping attachment for attachment to a motive power source that can be used to remove dirt from a site and to level the terrain afterward in a preferred manner.

It is yet another object of the present invention to provide a method for preparing a site for final landscaping tasks by providing for the selective removal of soil and subsequent leveling of the ground surface to the desired contours.

The foregoing objects of the present invention and others that will become apparent to those skilled in the art are provided by a bucket level mountable to a motive power source such as a skid steer loader, tractor, or the like. A bucket level in accord with the present invention may have a frame substantially configured as a bucket with a floor, side walls, and a rear wall. The bucket floor will comprise front, middle, and rear sections, with the front and rear sections being fixedly attached to the side walls and the middle section being movable relative to the side walls to raise it above the front and rear sections. The front and rear sections may have blade edges on both their forward and back edges to aid in cutting into the ground and leveling when the bucket level is used as a leveling bar.

The rear wall will include upper and lower sections with the lower section taking the general form of a pivotable door or gate that opens when the middle floor section is raised. This opening of the door creates a flow-through in both forward and rear directions during operation. When the middle floor section is raised, then, the rear gate opens to allow the bucket level to be pushed or pulled by the power source along the ground, enabling the blade edges of the front and rear sections to level the ground and enabling material to flow through the rear gate in a controlled volume.

When the middle section is in its operational or lowered position, the rear gate will be closed and the bucket level can be used as a traditional bucket. An appropriate linkage operates to open the gate as the middle floor section is raised and to close the rear gate as the middle section is lowered.

In a method in accord with the present invention there is provided a landscaping apparatus that is selectively configurable to adopt the configuration of a bucket or a leveling bar. An apparatus useful in a method in accord with the present invention may have a bucket and a leveling bar apparatus formed by selective displacement of a portion of the bucket floor. The apparatus is mounted to an appropriate power source and topsoil and other materials are removed using the bucket to a desired depth. The movable portion of the bucket floor is moved to form the leveling bar apparatus and the landscaping apparatus is moved over the ground to smooth and contour it as desired.

These and other objects, advantages, and features of an embodiment of the present invention will be appreciated by those skilled in the art when the following drawings are considered in conjunction with the accompanying text description.

DETAILED DESCRIPTION OF THE INVENTION

Figure 1:
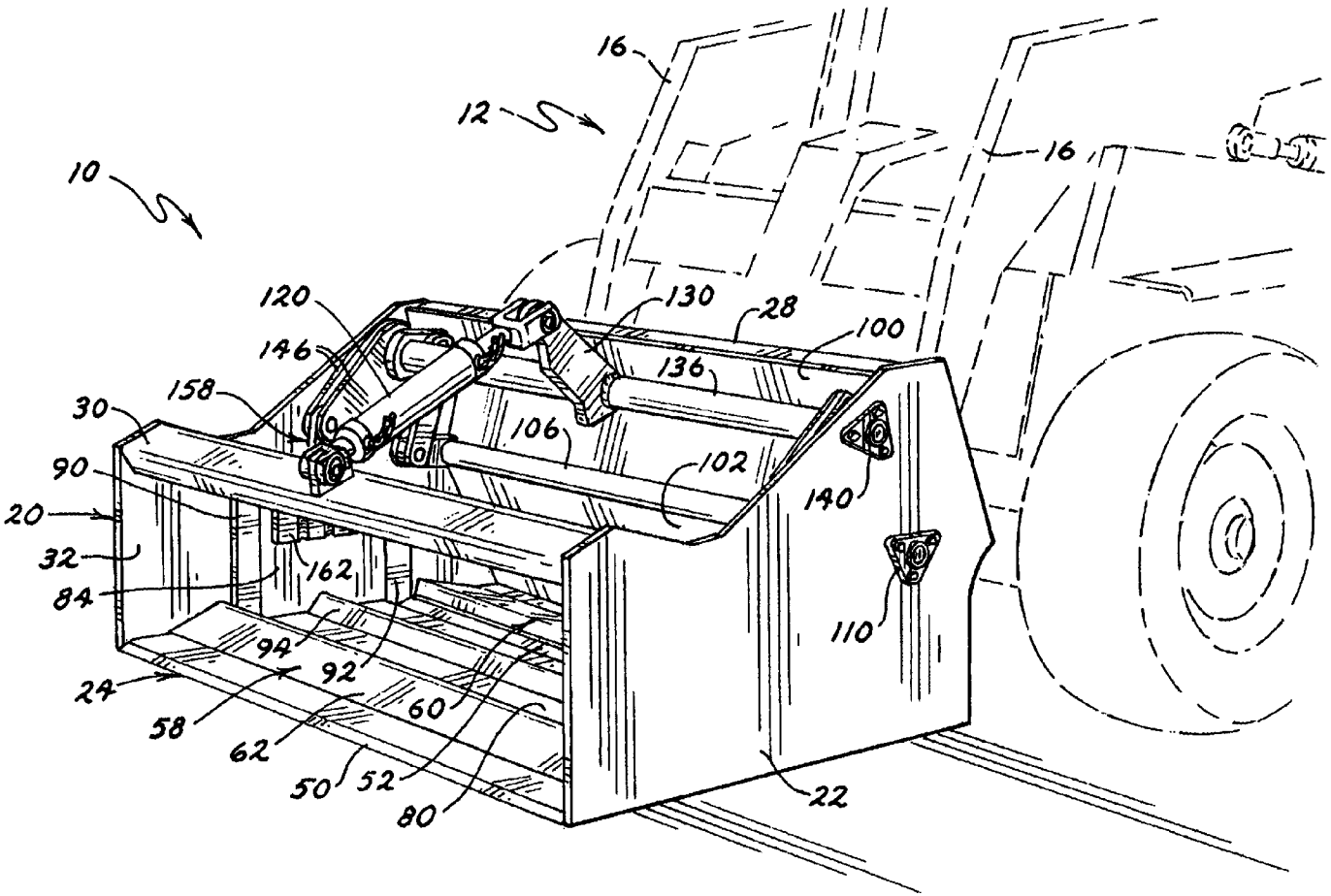
FIG. 1 illustrates an embodiment of the present invention in a perspective view.

An embodiment of a bucket level 10 in accord with the present invention is shown in FIG. 1 attached to a motive power source 12 in the form of a skid steer loader. It will be appreciated by those skilled in the art that a level 10 in accord with the present invention could also be mounted to other power sources, such as a tractor, with the appropriate mounting equipment. When used with a skid steer loader such as loader 12, standard mounting brackets 14, shown in phantom in FIGS. 3 and 5, can be provided on the bucket level 10 for mounting the bucket level 10 to the arms 16 of the loader.

The bucket level 10 includes a pair of side walls 20 and 22, a bottom floor 24, and a rear wall 26. One or more reinforcement members 28, 30 may be provided and may be attached to and extend between the interior surfaces 32 and 34 of side walls 20 and 22, respectively.

Figure 2:
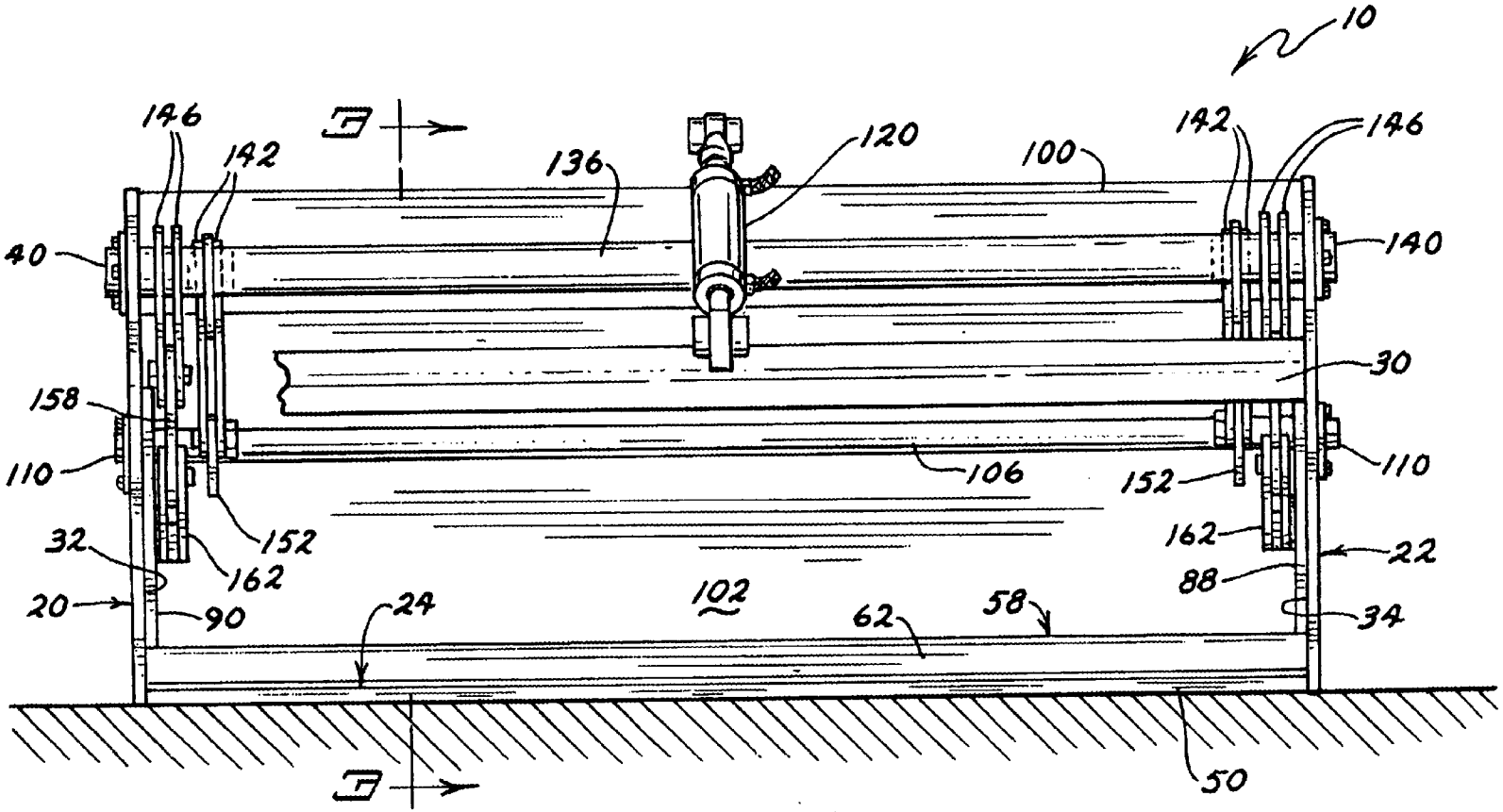
FIG. 2 illustrates the embodiment shown in FIG. 1 in a front elevation view.

Referring now to FIGS. 1 and 2 generally and FIGS. 3 and 4 in particular, floor 24 will be described. Floor 24 includes a front, middle, and rear sections 40, 42, and 44, respectively. Front and rear sections 40 and 44 are attached to and extend between interior surfaces 32 and 34 of side walls 20 and 22, respectively. Each floor sections 40, 44 may include a base member 46, 48, which in turn may each have a front blade edge 50, 52 and a rear blade edge 54, 56, respectively.

Front and rear floor sections 40 and 44 may further include an agitator member 58 and 60, respectively, that are attached to each section base member 46 and 48 and that extend therealong its length between the side walls 20 and 22. The agitators 58 and 60 can also serve a strengthening function for the floor sections 40 and 44, respectively. As shown, each agitator 58, 60 takes the form of an angle iron, though other forms may also be used. Each agitator 58, 60 includes long sides 62, 64 and short sides 66, 68, respectively. The short sides 66, 68 are disposed nearest the middle section while the long sides 62, 64 extend toward the front and rear, respectively, of the bucket level 10. A bucket level 10 with agitators such as agitators 58, 60 functions to also tumble the soil passing thereover, thereby contributing to the breaking up of dirt clods when the apparatus 10 is used as a leveling bar.

Middle floor section 42 will now be described. As shown, middle floor section 42 may include a middle section base member 80 and end plates 82 and 84 lying substantially adjacent to the side walls 20 and 22, respectively. The end plates are attached to the base member 80 in any known, appropriate manner. Middle floor section 42 is, as previously noted, movable upwardly relative to the front and rear floor sections 40, 44. To facilitate this movement, a pair of guide plates 86, 88 are attached to side wall 20 and a pair of guide plates 90, 92 are attached to the side wall 22. Guide plates 86, 88 are space apart to slidably receive end plate 82 therebetween. Guide plates 86, 88 thus constrain the end plate 82 to move substantially upwardly relative to the floor sections 40, 44 by inhibiting its movement in a forward or rear direction. Guide plates 90, 92 are space apart to slidably receive end plate 84 therebetween. Guide plates 90, 92 thus constrain the end plate 84 to move substantially upwardly relative to the floor sections 40, 44 by inhibiting its movement in a forward or rear direction. If desired, middle floor section 42 may also include an agitator 94 comprising an angle iron with equal sides attached thereto. As shown, agitator 94 is attached substantially in the center of the base member 80. Agitator 80 may also function to tumble soil as it passes thereover to break up clods and may also act to strengthen and support the base member 80.

Figure 3:
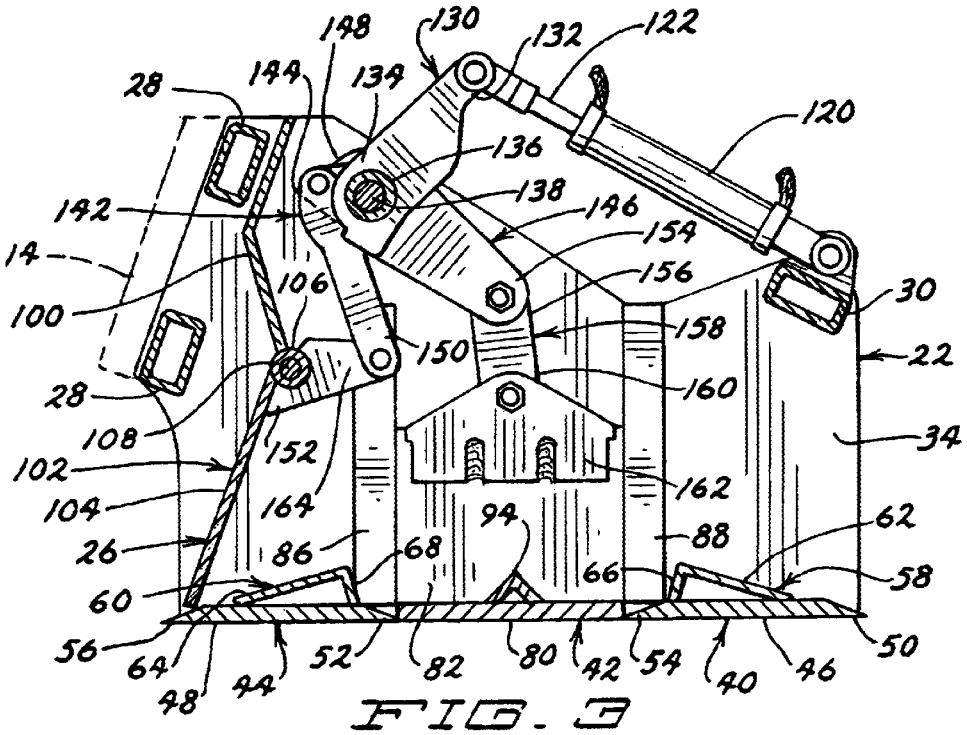
FIG. 3 shows the embodiment of FIG. 1 in a side elevation, cross sectional view taken along viewing plane 3—3 of FIG. 1.
Figure 4:
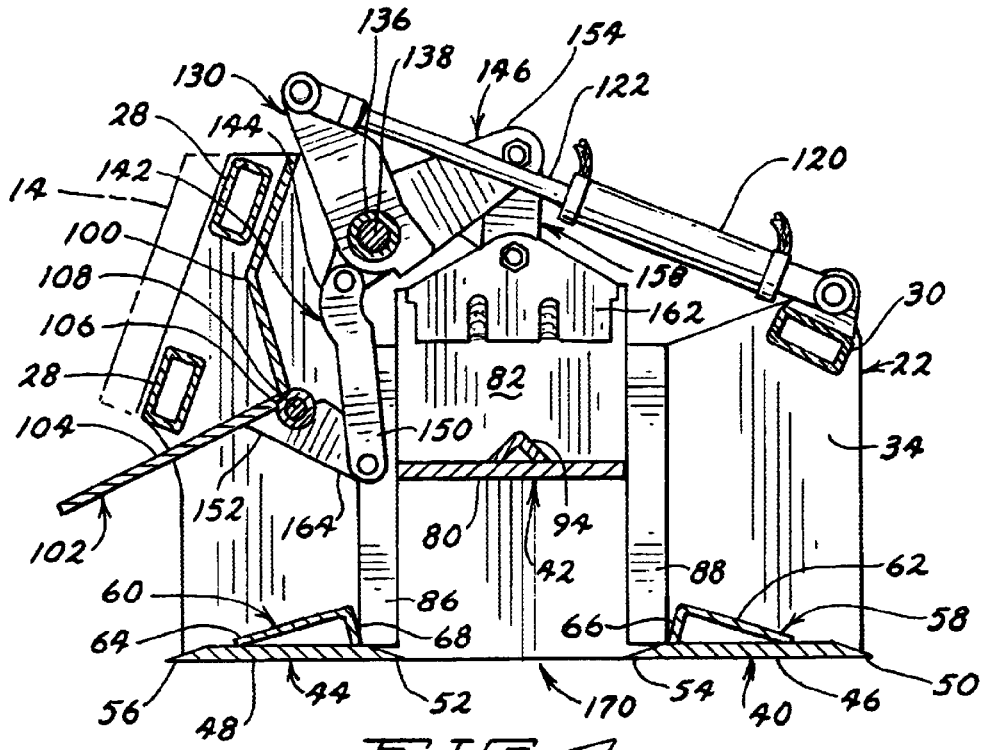
FIG. 4 shows the embodiment of FIG. 1 in a side elevation, cross sectional view taken along the same viewing plane as that of FIG. 3 but with the ?? in its elevated, non-operational position and the rear door in its open position.

Referring particularly now to FIGS. 3 and 4, rear wall 26 will now be described. Rear wall 26 may include an upper rear wall section 100 and a lower rear wall section comprising a pivotable gate section 102. Upper rear wall section 100 extends between and is attached to the inner surfaces 30, 32 of the side walls 20, 22, respectively. As shown the rear wall section 100 comprises an angle iron, but other configurations may also be used, if desired. The rear wall section 100 engages but is not attached to the gate section 102.

The gate section 102 comprises a gate 104 including a gate collar 106 that receives a shaft 108. The ends of the shaft 108 may be mounted in appropriate bearings 110 attached to the side walls 20 and 22 as best seen in FIG. 1. As shown, the gate 104 is fixedly attached to the shaft 108 so that the two pivot or rotate jointly, though if desired the gate 104 could rotate or pivot about a shaft fixed in position. Comparing FIGS. 3 and 4, it can be appreciated that the gate 104 can be pivoted from its closed position in FIG. 3 to its open position in FIG. 4.

As will be explained hereafter, gate 104 and middle floor section 42 are mechanically linked so that movement of one results in movement of the other. With the mechanism to be described hereafter, the movement of the gate 104 and the floor section 42 is accomplished simultaneously through individual connections to an actuator, though it will be understood that other mechanisms for moving them could also be used wherein only one of the two were connected to an actuator and the other was moved through a mechanical linkage.

Thus, referring to FIGS. 1, 3 and 4 in particular, it will be observed that an actuator in the form of an hydraulic cylinder 120 is attached to the front member 30. The piston 122 of the cylinder 120 is pivotally attached to a rocker arm 130 at a first rocker arm end 132. The rocker arm 130 is attached at the other or second end 134 to an actuator collar 136 that receives an actuator shaft 138 supported by appropriate bearings 140 attached to the side walls 20 and 22.

At the outside ends the actuator collar 136 is pivotally attached to a gate link 142 at a first gate link end 144 and to floor link 146 at a first floor link end 148. The other end 150 of gate link 142 is pivotally attached to a gate member 152, which is fixedly attached to the gate collar 106. The other end 154 of the floor link 146 is pivotally attached to an end 156 of a floor arm 158. The other end 160 of the floor arm 158 is pivotally attached to a middle floor section attachment member 162. The attachment member 162 is attached to the end plate 82 of the middle floor section 42.

In operation, as the piston 122 is extended the various linking members previously described transfer the extension motion to the gate 102 and the middle floor section 42, causing the gate to pivot rearwardly to open and the middle floor section 42 to be raised, creating the leveling bar position. Thus, as the piston 122 extends, the rocker arm 130 is rotated backwards or counterclockwise about the axis of the shaft 138 as seen in FIGS. 3 and 4. This rotation of the rocker arm 130 in turn rotates the collar 136, causing the gate link 142 to rotate downwardly as can be seen from comparison of the Figures. This downward movement in turns pushes the gate member end 164 downwardly to rotate it clockwise about the axis of the gate shaft 108 and thus rotating the gate 102 also clockwise and opening it. As the gate 102 is opening, the floor link 146 is rotating counterclockwise thereby lifting the end 154 of the floor link 146, which in turn lifts the middle floor section 42 upwardly to create a gap 170 between front floor section 40 and rear floor section 44, thus creating the leveling bar formation. Retracting the piston 122 will reverse the previously describe motions and result in the gate 102 being closed and the floor section 42 being lowered to create the bucket formation.

Figure 5:
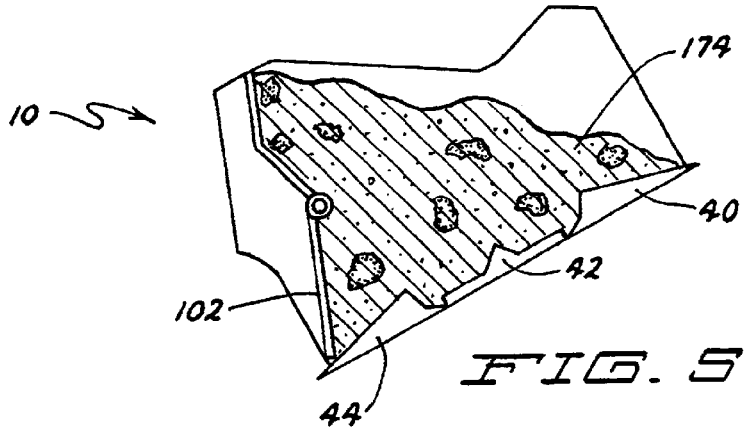
FIG. 5 depicts a bucket level in accord with the present invention being used as a bucket to pick up and haul dirt and other materials from one location to another.
Figure 6:
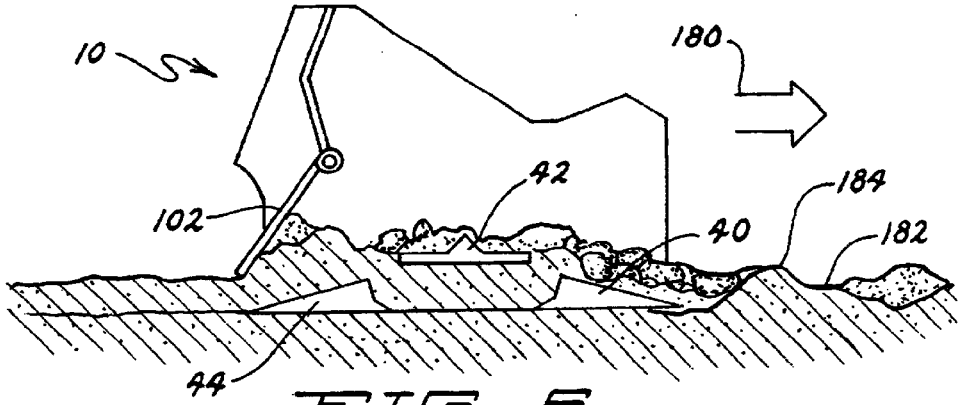
FIG. 6 illustrates a bucket level in accord with the present invention wherein the bucket level is being moved forwardly and the gate is partially opened and the bucket level is being used in its leveling bar position to level or otherwise smooth an uneven ground surface.
Figure 7:
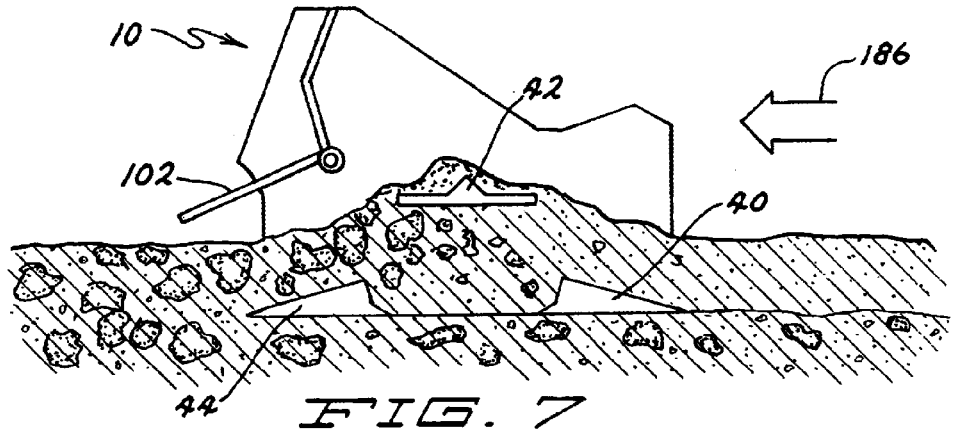
FIG. 7 shows the level bucket with the gate farther open than shown in FIG. 6 and wherein the bucket level is being moved in a rearward direction.

Referring now to FIGS. 5–7, the operation of an apparatus in accord with the present invention will be described. In FIG. 5 the bucket level 10 is shown with the gate 102 and middle floor section 42 both closed to create the bucket formation. In this formation, the apparatus 10 can be used as a traditional bucket and can carry dirt or other material 174 therein. In such a use, it would be tipped slightly backward as shown to minimize material falling off the front. As known in the art, in this formation the bucket level would be slid along the ground to pick up dirt and materials or pushed into a pile of material to fill it.

FIG. 6 illustrates a use of the apparatus 10 as a leveling bar. As shown there, the gate 102 is partially opened and the middle floor section 42 is slightly raised above the other floor sections. As indicated by the arrow 180, the bucket level 10 is being pushed forwardly over an uneven ground surface 182. The front edge 50 of the front floor section 40 cuts into the high surface areas such as area 184 and the loosened material flows backwardly into the apparatus 10 and out the partially opened gate 102. As the material flows into and out of the bucket level 10, it will pass over the agitators 58 and 60 and a portion of the material may pass over agitator 94. As the material passes over the agitators it is rolled or tumbled, thereby helping to break up the clods that may be present. As the material exits the back of the apparatus 10 through the partially opened gate 102, the gate may be used to further level the material so that it exits in a substantially smooth layer and leaves the side with a substantially smooth surface. It will be understood that the front edge 62 of the rear floor section 44 may also cut away high areas during a forward motion operation such as that depicted in the Figure.

FIG. 7 represents a use of the apparatus 10 wherein the gate 102 is fully raised above the highest ground surface level and the apparatus 10 is being pulled rearwardly as indicated by arrow 186. During this operation rear edges 54 and 56 of the front and rear floor sections 40 and 44 are both capable of shearing the soil layers.

It will be understood that the gate 102 and the middle floor section 42 are capable of assuming incrementally opened positions between the fully closed position shown in FIG. 3 and the fully open position shown in FIG. 4. Thus, the operator is able to fully control the operation of the bucket level 10 by controlling the depth into which the apparatus is directed into the ground and the degree of open positions assumed by the gate 102 and the middle floor section 42.

A method of preparing a landscape in accord with the present invention then includes providing an apparatus capable of assuming a bucket and a leveling bar configuration; placing the apparatus in a bucket configuration for the removal of large amounts of materials and subsequently placing the apparatus in a leveling bar configuration for leveling uneven spots in the surface.

The present invention thus provides landscapers and others with a single mountable attachment capable of adopting two different two configurations, thus eliminating or reducing the need to switch attachments during landscaping operations. With the gate closed the apparatus has the configuration of a common bucket. With the gate open and the middle floor section elevated, the apparatus has the configuration of a leveling bar. The ability to control the depth into the ground in which the tool is placed facilitates the control of the volume of dirt going through the bucket level in either the forward or rear direction of operation.

The present invention having thus been described, other modifications, alterations, or substitutions may now suggest themselves to those skilled in the art, all of which are within the spirit and scope of the present invention. By way of example only, other mechanisms could be used in lieu of hydraulic cylinder 72, such as an air cylinder, linear actuator, or other known mechanical or electrical actuators to aid in the incremental opening and closing of the gate 102 and middle floor section 42. Also, the present invention has been illustrated herein with an embodiment wherein a mechanical linkage is used to place the gate and the middle floor section in their operating positions. However, other known forms of providing motion, such individually actuated hydraulic cylinders or linear actuators or other devices known to the art could be used to provide this positioning function and thus the physical linkage between them as shown herein could be obviated. It is therefore intended that the present invention be limited only by the scope of the attached claims below.

What is claimed is:

1. Apparatus for preparing a landscaping comprising:

a frame having a pair of side walls; a rear wall including a gate mounted for pivoting between open and closed positions; and a floor including front, middle, and rear floor sections, said middle floor section being mounted for movement from a closed position to an open position upwardly relative to said front and rear floor sections, wherein when said gate is in its closed position and said middle floor section is in its closed position said apparatus may be used as a bucket and when said gate and said middle floor section are open said apparatus may be used as a leveling bar.

2. The apparatus of claim 1 and further including means for attaching said apparatus to a motive power source.

3. The apparatus of claim 1 and further including means for moving said gate between its closed and fully open positions.

4. The apparatus of claim 3 and further including means for opening and closing said middle floor section.

5. The apparatus of claim 1 and further including means for opening and closing said middle floor section.

6. The apparatus of claim 1 and further including means for substantially simultaneously opening said gate and said middle floor section.

7. The apparatus of claim 1 wherein at least one of said floor sections includes an agitator for tumbling materials passing thereover.

8. The apparatus of claim 1 wherein said middle floor section comprises a base member and a pair of end plates attached to said base member.

9. The apparatus of claim 8 wherein each said side wall includes a pair of spaced apart guide plates for slidably receiving therebetween an end plate of said middle floor section, said guide plates being provided to guide said middle floor section as it is being moved into its open position.

10. The apparatus of claim 1 wherein at least one of said front and rear floor sections includes a front blade edge.

11. The apparatus of claim 10 wherein at least one of said front and rear floor sections includes a rear blade edge.

12. The apparatus of claim 1 wherein said front and rear floor sections each includes a base member and each base member includes front and rear blade edges.

13. The apparatus of claim 12 wherein at least one of said front and rear floor sections includes an agitator attached to said base member for tumbling materials passing thereover.

14. The apparatus of claim 1 and further including means for incrementally opening said gate and middle floor section.

* * * * *